US007856803B2

(12) United States Patent
Özmerzi et al.

(10) Patent No.: US 7,856,803 B2
(45) Date of Patent: Dec. 28, 2010

(54) CONNECTION OF STEEL CORD ENDS

(75) Inventors: Ferhat Özmerzi, Aalter (BE); Jan Creus, Ghent (BE); Johan Vyncke, Maldegem (BE)

(73) Assignee: NV Bekaert SA, Zwevegem (BE)

( * ) Notice: Subject to any disclaimer, the term of this patent is extended or adjusted under 35 U.S.C. 154(b) by 388 days.

(21) Appl. No.: 12/063,533

(22) PCT Filed: Jul. 18, 2006

(86) PCT No.: PCT/EP2006/064366

§ 371 (c)(1),
(2), (4) Date: Feb. 11, 2008

(87) PCT Pub. No.: WO2007/020148

PCT Pub. Date: Feb. 22, 2007

(65) Prior Publication Data

US 2010/0170214 A1 Jul. 8, 2010

Related U.S. Application Data

(60) Provisional application No. 60/709,453, filed on Aug. 19, 2005.

(30) Foreign Application Priority Data

Aug. 19, 2005 (EP) ..... 05107647

(51) Int. Cl.
*B65H 69/06* (2006.01)

(52) U.S. Cl. ..... 57/22; 57/202

(58) Field of Classification Search ..... 57/21, 57/22, 23, 202, 236
See application file for complete search history.

(56) References Cited

U.S. PATENT DOCUMENTS

| | | | | |
|---|---|---|---|---|
| 3,908,715 | A * | 9/1975 | Spiessens | 140/111 |
| 4,258,543 | A | 3/1981 | Canevari et al. | |
| 5,099,902 | A * | 3/1992 | Shurman | 152/540 |
| 6,381,939 | B1 * | 5/2002 | Brown et al. | 57/202 |
| 2005/0172605 | A1 * | 8/2005 | Vancompernolle et al. | 57/237 |
| 2005/0257874 | A1 * | 11/2005 | Soenen et al. | 156/47 |

FOREIGN PATENT DOCUMENTS

| | | | |
|---|---|---|---|
| EP | 0 676 500 | B1 | 12/1999 |
| EP | 1 036 235 | B1 | 2/2003 |
| EP | 1 384 809 | A1 | 1/2004 |
| WO | WO 95/16816 | A1 | 6/1995 |
| WO | WO 03/100164 | A1 | 12/2003 |

* cited by examiner

*Primary Examiner*—Shaun R Hurley
(74) *Attorney, Agent, or Firm*—Foley & Lardner LLP

(57) ABSTRACT

A connection for connecting steel cord ends to one another is described. The connection solves the problem of filaments that break off at the connection during handling of the cord. In the inventive connection a fixation section is introduced before or after the jointing section. The fixation section immobilizes the filaments relative to one another. A method to make such a connection is also described. The connection and the method turn out to be extremely useful for connecting steel cords of the open type.

17 Claims, 1 Drawing Sheet

CONNECTION OF STEEL CORD ENDS

FIELD OF THE INVENTION

The invention concerns a connection between two lengths of steel cord so as to obtain one single length that can be processed further without problem. The invention extends also to a method for making such a connection.

BACKGROUND OF THE INVENTION

Steel cord users request longer and longer lengths on spools in order to reduce the downtime of the costly installations using such cords.

For example steel cord that is used to reinforce the belt or the carcass of a tyre is unwound from a creel containing sometimes hundreds of spools. These cords are calendered parallel to one another in rubber thus forming a steel cord reinforced ply for further processing into a tyre. Replacement of the empty spools with full ones is a laborious task one seeks to minimise. This is achieved by using larger spools containing longer lengths of cord. However, steel cord manufacturers cannot always deliver each spool at the full length requested without any interruption because the filament lengths are not always multiples of the final creel length. Additionally, in the manufacturing of steel cord random breaks can occasionally interrupt the process. Breaks are due to imperfections in the steel filaments attributable to e.g. non-deformable inclusions already present in the raw material. Therefore, incomplete lengths are interconnected and rewound at the required length. Although such an interconnection is extremely rare it must be able to withstand the calender process problem-free, because failure of such a single connection on one spool may lead to the halt of the complete creel resulting in lost production time and scrapped material.

Another example where steel cords must process without interruption is when these steel cords are used as strands in a steel cable. During the final closing step, such strands are unwound at high speed from spools in a cabling machine. The strands follow a—sometimes complicated—path through the machine while being tensioned, twisted and bent. Again failure of the connection will lead to the complete stop of the machine and an irreparable cable interruption.

There are different methods known in the art to connect steel cords together:

- One way is to swage a ferrule over both ends held end-to-end. Such a ferrule can be made of an easily deformable metal like a copper or an aluminium alloy. The disadvantage of this connection is that it is substantially thicker than the cord itself. The steel cord is guided over many wheels, over wear parts and through holes after being unwound. The ferrule gets easily caught by these guiding parts and breaks. Also the connection is much stiffer.
- An alternative to the swaging method is to use a polymer sleeve. This sleeve can be glued or heat shrunk over the cord ends. Although this connection is more flexible, the diameter problem remains. In addition, the connection is only borderline strong enough to hold the tensile forces occurring during the process.
- By far the most preferred connection for a steel cord is a weld such as described in WO 03/100164. A good weld is made by locally shortening the lay length at each steel cord end prior to butt welding them together. During welding a blob of molten steel forms in which all filaments coalesce. By preference the welding process is followed by a thermal annealing of the welding area. Although the strength of the cord containing a weld is significantly lower than the strength of the weld-free cord (usually one loses 50 to 60% of the cord strength at the weld) this is not an immediate problem to process the cord further. The diameter of the weld can be controlled by hammering. The norm is that the diameter at the weld must not be larger than 1.10 times the diameter of the cord.

However one major drawback to the welding method remains. Steel cords are made of steel filaments that are twisted together. The steel filaments are cold drawn and due to this strain hardening process their tensile strength (breaking load per unit area) is greatly increased. This increase finds its origin in the changed metallurgical structure of elongated perlitic grains wherein dislocations are rearranged so as to prevent crystallographic planes from gliding over one another. By making a weld this structure is locally disturbed and an annealed martensitic structure is formed in the weld. Although such a structure is strong it is more brittle. In addition there is a transition region between annealed martensitic and cold-drawn perlitic where the filaments tend to break off easily upon bending. So during handling of the cord, it is not the weld that gives in, but it are filaments that crack very close to the weld. While such a filament break may not lead to a cord breakage, the loose filament end will disentangle from the cord and can be stripped off, leading to a complete process stop.

This 'filament breaking problem' occurs with all kinds of steel cords but is particularly severe when so called 'open cords' are welded. Such open cords comprise filaments that are preformed in one or another way (e.g. helically preformed as described in U.S. Pat. No. 4,258,543, polygonally preformed as per WO 95/16816 or double crimped according EP 1036235 B1). Due to the preforming the filaments can move relative to one another as they are not always in contact with one another. When now such a cord is led through a narrow-fitting hole or is squeezed while being encapsulated in the rubber, some filament may accumulate an overlength with respect to the other filaments. Such a filament visibly separates from the other filaments and shows as an eyelet rotating around the cord as the cord evolves. After a while the overlength on one filament may disappear followed by the formation of an eyelet on another filament. This phenomenon is known in the art as 'sleeving'. Such a sleeving on itself is relatively harmless and is intrinsic to the open cord structure. However, when sleeving occurs at a weld, it becomes catastrophic as the overlength is pulled to the weld where all filaments are molten together. The filament cannot longer move and cracks between the restraining hole and the weld. The filament is stripped off and forms a wire nest. If the process is stopped soon enough the damage can be contained. If not, the cord will break and entangle cords leading to a complete creel mess.

Prior to the proposed invention, it was not possible to supply open cords that contained welds. Although most welds went through without giving 'filament breaking' problems, the 'survival rate' was never high enough to enable a stable and economic process. With the inventive connection, the 'filament breaking problem' is a problem of the past.

SUMMARY OF THE INVENTION

It is a first object of the invention to provide a connection between steel cords that does away with the problems with known connections. More specifically, the object of the invention is to eliminate the 'filament breaking problem'.

More in particular the object is to eliminate this problem in various processes such as:

- the production of steel cables where the steel cord is used as a strand in a cable forming machine
- the production of steel cord reinforced elastomer articles such as rubber plies to make a tyre, or a polyurethane timing belt, or a rubber conveyor belt, or rubber hose or any article related.

The invention will now be laid open in more detail.

According a first aspect of the invention, the inventive connection comprises a known end-to-end connection of two steel cord ends. The filaments at both ends are ending equally for example by cutting them flush with cable scissors. Both ends are jointed together thus forming a jointed section. All filament ends are fixed in this jointed section. The jointed section basically transfers all forces and moments acting on the first steel cord to the second steel cord. The inventive connection discriminates itself from the known connections in that in the vicinity of the jointed section, a fixation section is present. In this fixation section, all filaments are immobilised relative to one another i.e. they cannot move radially nor longitudinally with respect to one another. There is no interruption of the filament in the fixation section.

The role of the fixation section is to isolate any sleeving of filaments that could occur from the jointing section. In other words: due to the fact that the filaments cannot move relative to one another in the fixation section, any accumulation of overlength occurring on a filament at a restrainer such as a guiding piece or hole during unwinding will stop at the fixation section and the overlength will be subsequently pulled through the restrainer without reaching the jointing section. Hence there is not longer a risk that a filament will be torn loose from the jointing section.

From the above explanation it will be clear to the person skilled in the art what distance between fixation and jointing section is meant with the terms 'in the vicinity of' or 'near to' the jointing section. The distance should be less than the distance wherein an overlength can build up. Intuitively it is clear that more overlength can build up per unit length of cord when the lay length of the steel cord is short. This is because shorter lay lengths imply more filament length per unit length of cord, and hence accumulation of overlength will be higher per unit length of cord that passes the restrainer when shorter lay lengths are used. With the lay length of the steel cord is meant that length along the cord wherein a filament completes a complete turn around the axis of the cord. The distance between fixation and jointing section is therefore best expressed in multiples of the lay length of the cord. Surely when that distance is below about 50 times the lay length of the steel cord, the risk for overlength accumulation is small. Even better is if this distance is below 10 times the lay length of the steel cord. There is no reason why the fixation section could not be adjoin to the jointing section. Important is that the overlength never reaches the jointing section. In practice distances between fixation section and jointing section turns out to be from a few millimetres to a few centimeters: e.g. from 1 to 10 cm.

The length of the fixation section should in principle be long enough so as to hold the wandering filament attached to the other filaments as the overlength passes the restrainer. This will depend on the type of fixation means used (see further). However, the length of the fixation section should not be too long as in this section the cord becomes noticeably stiffer: the filaments can indeed not longer act independently from one another. In practice fixation means exist that can keep this fixation length below a couple of centimeters.

By preference the order in which the novel connection reaches the restrainer is such that first the fixation section passes the restrainer and then the jointing section. If this direction can be known, one fixation section is enough the prevent filaments from breaking out of the jointing section. So during winding and jointing of the final spool, first the jointed section will be made followed by the fixation section because during use the order will be reversed. However a small risk exists that spools are again rewound and this of course reverses the order of both sections. If one wants to eliminate this minor risk completely, it is better to put a fixation section at both sides of the jointing section. These fixation sections are then to be situated at either side of the jointing section.

A number of jointing methods can be used to joint the steel cord ends in the jointing section. By far the most preferred is a weld, such as described in the previous section. It can made be easily in production with a small portable cord welding unit, one does not need additional materials, and it can be made relatively fast. Moreover the weld can be hammered so that its overall diameter is about the diameter of the cord. This preference does however not exclude other means to make a joint, such as gluing the ends to one another. Knotting is least preferred because this gives an unacceptable diameter increase at the joint.

Likewise a number of fixation methods exist. Important there is that they immobilise the filaments to one another and that the filaments remain uninterrupted and unaltered. Fusing the filaments together (e.g. by heating them until they are red-hot with a welding unit) is in this respect not the preferred option because it changes the structure of the steel at the fixation section into the more brittle martensitic phase. Better is to glue them together because then the metallographic structure is not changed at all. However, drying of the glue may take some time and the strength of the fixation could be better. By far the most preferred way to immobilise the filaments is the soldering or the brazing of the filaments. Such a fixture is strong—as the molten solder easily wets the steel filaments and completely penetrates it—is rapidly made and does not change the metallographic structure of the steel appreciably.

Also a steel cord in whatever kind of appearance (on a creel spool, on a machine spool, embedded in rubber or in any other form) containing such a connection is claimed. The connection can be easily found by visual inspection or by magnetic or other means.

A second aspect of the invention relates to the method that is used to make such a connection. In essence it comprises two steps: first steel cords are jointed at a jointing section followed by the step of immobilising the filaments in the steel cord. The first step is known in the art and is straightforward. After cutting the filaments flush at both ends, they are by preference welded to one another (although other jointing methods are equally possible as explained before). Reference is made to WO 03/100164 wherein this procedure is clearly explained (see page 3, line 20 to page 4 line 25). The second step embodies the invention as the filaments are there fixed to one another in the vicinity of the jointing section.

Again the second step can be applied either at one side of the jointing section or a both sides of the jointing section. The jointing section may comprise a weld or may be made by any other method known in the art. Immobilising of the filaments is preferentially done by brazing or soldering them together or by gluing them together.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
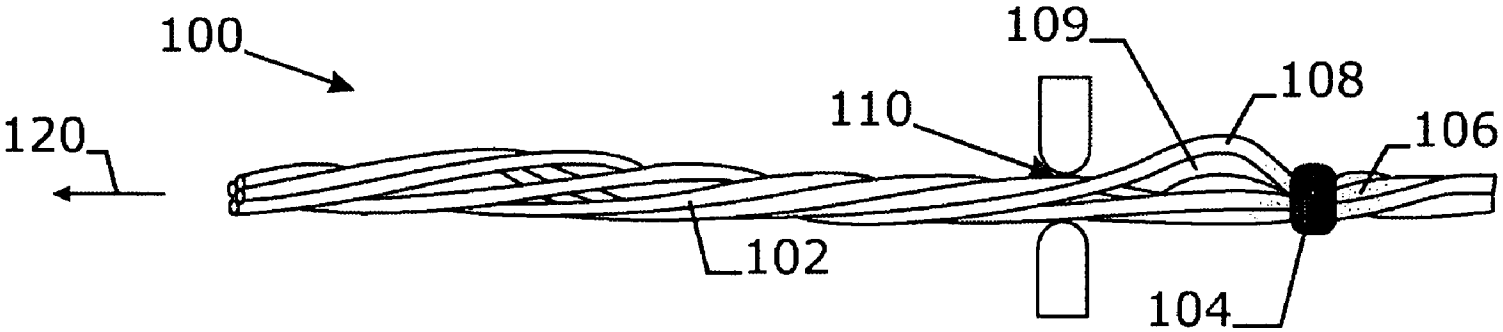
Fig. 1 Prior art
FIG. 1 shows the prior-art connection and the filament breaking problem associated with this type of connection.

FIG. 1 shows the prior-art type of connection applied to an open cord 100. Such a cord comprises a number of filaments 102 that are loosely twisted around one another. When now a weld 104 is made between two such steel cord ends, a region 106 will form wherein the metallic structure of the steel changes from a strain hardened perlitic structure (in the filament) into a brittle martensitic structure (in the weld). If a steel cord containing such a weld is drawn through a hole 110, one of the filaments e.g. 108 may build up an overlength leading to an eyelet 109 that remains in front of the hole 110 while the steel cord is pulled in the direction of the arrow 120. As the weld approaches the hole, the filament will break loose from the weld as the eyelet 109 is squeezed between weld 104 and hole 110. The filament end will therefore break out of the weld due to the more brittle martensitic structure.

Figure 2:
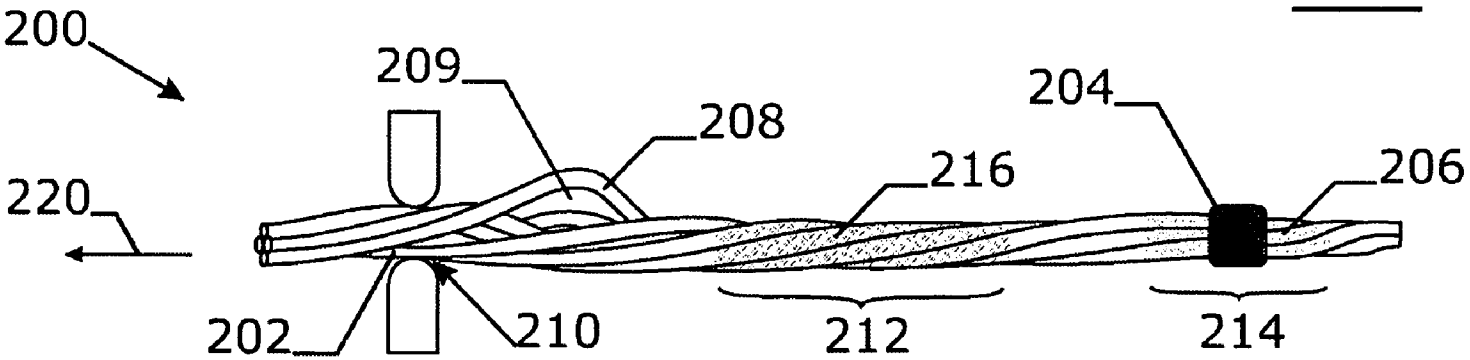
FIG. 2 shows the inventive type connection and is used to explain how the invention solves the problem.

In FIG. 2 the inventive connection is shown. Basically the cord 200 and filaments 202 remain the same. Also the weld 204 and the transition 206 from strain hardened perlitic steel to martensitic steel remains. The difference is the fixation section 212 where the filaments are glued together by means of solder. The filaments metallurgical structure within said fixation section remains substantially the same. When now this connection is pulled through a hole 210 again an eyelet 209 may build up. But now the overlength of filament 208 will be forced through the hole 210 as the filament is held in the fixation section. There is no risk that the filament will break out of the fixation section, as the filament does not end there, nor has its metallurgical structure been changed substantially by the soldering.

The novel connection has been tested extensively on a Betru® $1_{crimped}$+6 type of open cord. Such a cord and the manufacture thereof is described in EP 0 676 500 B1. It consists of a core filament of diameter 0.315 mm that has been crimped in a single plane. Around this core filament six filaments of size 0.30 mm have been twisted with a lay length of 16 mm in 'S' direction. Such a cord shows an open structure, as the crimped centre filament tends to pull the sheath filaments apart. However, due to the open structure the outer filaments tend to sleeve slightly when pulled over a restrainer such as wear piece or a hole or even the rubber into which the cord is calendered.

When prior-art welds were used, they gave problems due to filament breakages during creel runs. The novel connection was then introduced comprising a weld and two fixation sections at both sides of the weld spot. Fixation was achieved by soldering the filaments together with lead-free tin solder wire obtainable from the Farnell Cy. The fixation sections are about 1 to 1.5 cm long and are situated at about 10 cm from the weld. The solder is applied by heating the cord locally by means of electrical current while holding the solder wire tip against it. As soon as the solder melts (at about 230° C.) and wets the filaments, the heating is stopped in order not to change the metallic structure of the wire substantially. Since the novel connection and the associated method has been used, no more filament fractures have occurred during creel runs.

The invention claimed is:

1. A connection of two steel cord ends, said steel cord ends including filaments ending flush, said connection comprising:

one jointed section for connecting said steel cord ends to one another through a joint, and a fixation section that immobilizes the filaments of one of the steel cords relative to one another with a fixation device, said fixation section being near to said jointed section and said fixation device being different from said joint.

2. A connection of two steel cord ends, said steel cord ends including filaments ending flush, said connection comprising:

one jointed section for connecting said steel cord ends to one another through a joint, and two fixation sections, one at either side of said jointed section, configured to immobilize said filaments relative to one another with a fixation device, said fixation sections being near to said jointed section and said fixation device being different from said joint.

3. The connection according to claim 1, wherein two fixation sections are provided, one at either side of said jointed section.

4. The connection according to claim 1, wherein said jointed section comprises a weld.

5. The connection according to claim 1, wherein the immobilisation of said filaments in said fixation section is achieved by brazing or soldering the filaments together.

6. The connection according to claim 1, wherein the immobilisation of said filaments in said fixation section is achieved by gluing said filaments together.

7. A steel cord comprising a connection according to claim 1.

8. A method to connect two steel cord ends, said steel cord ends including filaments, comprising the steps of:

jointing the steel cord ends in a jointing section, fixing the filaments of at least one of the steel cords relative to one another in a vicinity of the jointing section, wherein the steps of jointing and fixing are different steps.

9. The method of claim 8, wherein the filaments are fixed at one side of the jointing section and spaced apart from the jointing section.

10. The method of claim 8, wherein the filaments are fixed at either side of the jointing section.

11. The method according to claim 8, wherein the steel cord ends are welded to one another.

12. The method according to claim 8 wherein the steel cord filaments are fixed relative to one another by soldering or brazing.

13. The method according to claim 8, wherein the steel cord filaments are fixed relative to one another by glue.

14. The connection according to claim 1, wherein the fixation device is spaced from the jointed section along a length of the one of the steel cords such that the fixation device is spaced apart and separate from the jointed section.

15. The connection according to claim 14, wherein the one of the steel cords includes a transition region in which a metallic structure of the one of the steel cords comprises a martensitic structure, wherein the fixation device is spaced from the jointed section along the length of the one of the steel cords such that the fixation device is spaced apart and separate from the joint and the transition region.

16. The method according to claim 8, wherein the filaments are fixed together at a region spaced from the jointing section along a length of the one of the steel cords such that a fixation region is spaced apart and separate from the jointing section.

17. The method according to claim 16, wherein the one of the steel cords includes a transition region in which a metallic structure of the one of the steel cords comprises a martensitic structure, wherein a fixation region is spaced from the jointing section along the length of the one of the steel cords such that the fixation region is spaced apart and separate from the transition region.

* * * * *